US006195961B1

(12) United States Patent
Turfan

(10) Patent No.: US 6,195,961 B1
(45) **Date of Patent: *Mar. 6, 2001**

(54) STRETCH FILM ROLL MOUNTING FRAME

(75) Inventor: Faruk M. Turfan, Brossard (CA)

(73) Assignee: Illinois Tool Works, Inc., Glenview, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/208,775

(22) Filed: Dec. 10, 1998

(51) Int. Cl.[7] ..... B65B 41/00
(52) U.S. Cl. ..... 53/389.2; 53/556; 53/588
(58) Field of Search ..... 53/556, 588, 389.2

(56) References Cited

U.S. PATENT DOCUMENTS

| | | | | |
|---|---|---|---|---|
| 4,229,038 | * | 10/1980 | Drost . | |
| 4,587,796 | | 5/1986 | Haloila . | |
| 5,042,272 | | 8/1991 | Furr . | |
| 5,487,255 | * | 1/1996 | Soderberg | 53/588 |
| 5,515,666 | * | 5/1996 | Berger et al. | 53/588 |
| 5,517,807 | | 5/1996 | Morantz . | |
| 5,584,166 | * | 12/1996 | Lakey | 53/451 |
| 5,636,496 | * | 6/1997 | Pietilaet et al. | 53/588 |
| 5,746,308 | * | 5/1998 | Lin . | |
| 5,787,691 | | 8/1998 | Turfan et al. . | |

FOREIGN PATENT DOCUMENTS 2140782 12/1984 (GB) .

OTHER PUBLICATIONS

Octopus Stretch Wrappers, ITW Muller Company.

* cited by examiner

*Primary Examiner*—Eugene Kim
(74) *Attorney, Agent, or Firm*—Schwartz & Weinrieb

(57) ABSTRACT

A framework for mounting a wrapping material film roll spindle upon a film wrapping material dispensing assembly of a film wrapping or packaging machine comprises an external framework fixedly mounted upon the film wrapping material dispensing assembly, and an internal framework pivotally mounted interiorly of the external framework. A spindle is mounted upon the internal framework for supporting a roll of film wrapping material. The external framework comprises a rigidified four-sided framework defining an enclosed space within which the internal framework is disposed such that when the film wrapping material is dispensed, vibrations within the assembly are effectively eliminated or substantially reduced.

28 Claims, 4 Drawing Sheets

STRETCH FILM ROLL MOUNTING FRAME

FIELD OF THE INVENTION

The present invention relates generally to film wrapping or packaging machine apparatus, and more particularly to film wrapping or packaging machine apparatus wherein the apparatus or machines are provided with mechanisms which enable or facilitate plastic film or material to be wrapped around articles to be packaged.

BACKGROUND OF THE INVENTION

Film wrapping or packaging machine apparatus, wherein the apparatus or machines are provided with mechanisms which enable or facilitate plastic film or material to be wrapped around articles to be packaged, are of course well-known. Examples of such known apparatus or machines are disclosed within U.S. Pat. No. 5,787,691 which issued to Turfan et al. on Aug. 4, 1998, U.S. Pat. No. 5,517,807 which issued to Morantz on May 21, 1996, and U.S. Pat. No. 4,587,796 which issued to Haloila on May 13, 1986. A well-known conventional film wrapping packaging machine is also illustrated in FIG. 1 of the drawings, and it will be appreciated that all of these machines or apparatus are provided with or comprise substantially similar operating components. In connection with the machine or apparatus illustrated in FIG. 1, for example, a detailed description of the same will be omitted and the same will only be briefly described with respect to the major or primary operative components thereof so as to simply provide an overview of the operation thereof, and further in view of the fact that such major or primary operative components thereof do not comprise any part of the present invention except as will be specifically noted hereinafter.

More particularly, the film wrapping packaging machine illustrated in FIG. 1 is generally indicated by the reference character 10 and is seen to comprise a four-post upstanding framework 12 through which extends a conveyor 14 for transporting articles to be wrapped or packaged to a wrapping station 16 which is located substantially at the center of the region or boundary area peripherally defined by the upstanding posts of the framework 12. An upper frame member 18, which is vertically movable in a reciprocating manner with respect to the framework 12, rotatably supports a ring or circular track member 20 upon which is mounted a plastic film roll mounting and dispensing assembly 22 which includes a roll 24 of plastic wrapping film. Consequently, when the upper frame member 18 is moved in vertically upward and downward directions, and the ring or track member 20 is rotated with respect to the vertically movable upper frame member 18, film from the film roll 24 mounted upon the film roll mounting and dispensing assembly 22 can be withdrawn therefrom and applied to articles to be wrapped which are disposed or located at the wrapping station 16.

With reference now being made to FIGS. 2–4, particular details of the conventional film roll mounting and dispensing assembly 22, as they bear upon the development and improved nature of the present invention, will now be described. The film roll mounting and dispensing assembly 22 conventionally includes a plurality of film tensioning rollers or similar mechanisms 26 for providing the plastic wrapping film with the proper tension as the same is withdrawn from the roll 24 of plastic film such that the plastic wrapping film can be applied to the articles to be wrapped with a predetermined, proper, or desired amount of tension. In order to facilitate or enable the easy replacement or replenishment of a particular roll 24 of plastic film with a new roll 24 of plastic film when an original roll 24 of plastic film is depleted, it is also conventional to mount the roll 24 of plastic film upon a pivotable mounting assembly or framework which is mounted upon the film roll mounting and dispensing assembly 22 such that the roll 24 of plastic film is movable between two positions, that is, a first operative position at which the axis of the film roll 24 is substantially vertical whereby the plastic film can be withdrawn from the roll 24 of plastic film during operation of the wrapping machine or apparatus so as to wrap the articles to be packaged, and a second position at which the axis of the film roll 24 is tilted or inclined with respect to the first vertical position such that film rolls 24 may be easily mounted upon and removed from the film roll mounting and dispensing assembly 22 when replacement or exchange of film rolls 24 is to be achieved.

More particularly, the pivotable mounting assembly or framework for the roll 24 of plastic wrapping material is seen to comprise, as best seen in FIG. 2, a first inner frame member 28, and a second outer frame member 30. The lower ends of the inner and outer frame members 28,30 are interconnected by means of a base member 32, and a film roll support spindle 34 projects upwardly from the base 32 so as to mount the film roll 24 thereon as a result of the spindle 34 being axially inserted within the core member 36 of the film roll 24 as seen in FIG. 3. The inner frame member 28 of the film roll mounting assembly or framework is seen to be pivotally mounted upon a vertically extending inner frame member 38 which is rigidly connected to or an integral part of the film roll mounting and dispensing assembly 22, and the outer frame member 30 of the film roll mounting assembly or framework is seen to be pivotally mounted upon an outer frame member 40 of the film roll mounting and dispensing assembly 22 wherein the outer frame member 40 depends vertically downwardly from an upper transverse frame member, not shown, which is connected to the inner frame member 38 of the film roll mounting and dispensing assembly 22. In this manner, the outer frame member 40 of the film roll mounting and dispensing assembly 22 is seen to be disposed in a substantially cantilevered manner with respect to the film roll mounting and dispensing assembly 22 whereby the lower end of the outer frame member 40 of the film roll mounting and dispensing assembly 22 is not fixedly or rigidly supported with respect to the assembly or framework 22. While this mounting system for the film roll 24 is obviously operative, and the entire film wrapping or packaging machine 10 has been enormously commercially successful, it has been determined that as a result of the aforenoted cantilevered, non-rigid disposition of the outer frame member 40 of the film roll mounting and dispensing assembly 22, the film roll mounting assembly or framework is able to vibrate during, for example, film payout from the film roll 24 during a winding or packaging operation. Such vibrations can lead to improper film payout, improper tension values within the wrapping film being dispensed, and cracking or excessive wear of the film roll mounting assembly or framework.

A need therefore exists in the art for a new and improved film roll mounting assembly or framework which, in effect, provides for the fixed or rigid mounting of the film roll mounting assembly or framework upon the film roll mounting and dispensing assembly whereby the aforenoted vibrational problems or drawbacks characteristic of the conventionally known film roll mounting assemblies or framework systems can be substantially eliminated or significantly reduced. As a result, improved film payout and improved or more accurate tension values within the dispensed wrapping film, while a simultaneous reduction in the amount of wear upon the film roll mounting assembly or framework, can be achieved.

OBJECTS OF THE INVENTION

Accordingly, it is an object of the present invention to provide a new and improved film roll mounting assembly or framework for use upon a film wrapping or packaging machine.

Another object of the present invention is to provide a new and improved film roll mounting assembly or framework, for use upon a film wrapping or packaging machine, which will overcome the various operational drawbacks and disadvantages characteristic of the conventional film roll mounting assemblies or frameworks.

A further object of the present invention is to provide a new and improved film roll mounting assembly or framework, for use upon a film wrapping or packaging machine, wherein the film roll mounting assembly or framework is rigidly or fixedly mounted upon the film roll mounting and dispensing assembly of the film wrapping or packaging machine so as to effectively eliminate or significantly reduce the amount of vibration that the film roll mounting assembly or framework will experience attendant withdrawal or dispensing of the plastic wrapping film from the plastic film roll during a wrapping or packaging operation.

An additional object of the present invention is to provide a new and improved film roll mounting assembly or framework, for use upon a film wrapping or packaging machine, wherein the film roll mounting assembly or framework is rigidly or fixedly mounted upon the film roll mounting and dispensing assembly of the film wrapping or packaging machine so as to substantially eliminate or significantly reduce excessive wear of the film roll mounting assembly or framework.

SUMMARY OF THE INVENTION

The foregoing and other objects are achieved in accordance with the teachings of the present invention through the provision of a new and improved film roll mounting assembly or framework, for use upon a film wrapping or packaging machine or apparatus, wherein, as was the case in the conventional film wrapping or packaging machine or apparatus, the film roll mounting assembly or framework is substantially the same as or similar to the film roll mounting assembly or framework as has been employed within the conventional film wrapping or packaging machine or apparatus and is pivotally mounted upon the film roll mounting and dispensing assembly of the film wrapping or packaging machine or apparatus. However, in accordance with the specific teachings and principles of the present invention, the lower end of the conventionally cantilevered outer frame member is now extended beneath the pivotable film roll mounting assembly or framework and is rigidly or fixedly connected to the inner frame member of the film roll mounting and dispensing assembly by means of a lower transversely disposed connecting member.

As a result of the aforenoted structure, therefore, the film roll mounting and dispensing assembly now comprises a four-sided rigidized framework comprising vertically oriented inner and outer frame members, and upper and lower transversely oriented frame members within and upon which the film roll mounting assembly or framework is pivotally mounted. Since the film roll mounting and dispensing assembly now comprises a rigidized framework which no longer comprises, in effect, a cantilevered frame member, the rigidity and stability of the film roll mounting and dispensing assembly, as well as that of the film roll mounting assembly or framework mounted upon the film roll mounting and dispensing assembly, is remarkably improved and enhanced whereby the aforenoted vibrational problems characteristic of the conventional or prior art film roll mounting and dispensing assemblies of the known film wrapping or packaging machines or apparatus, are able to be effectively eliminated or significantly reduced.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
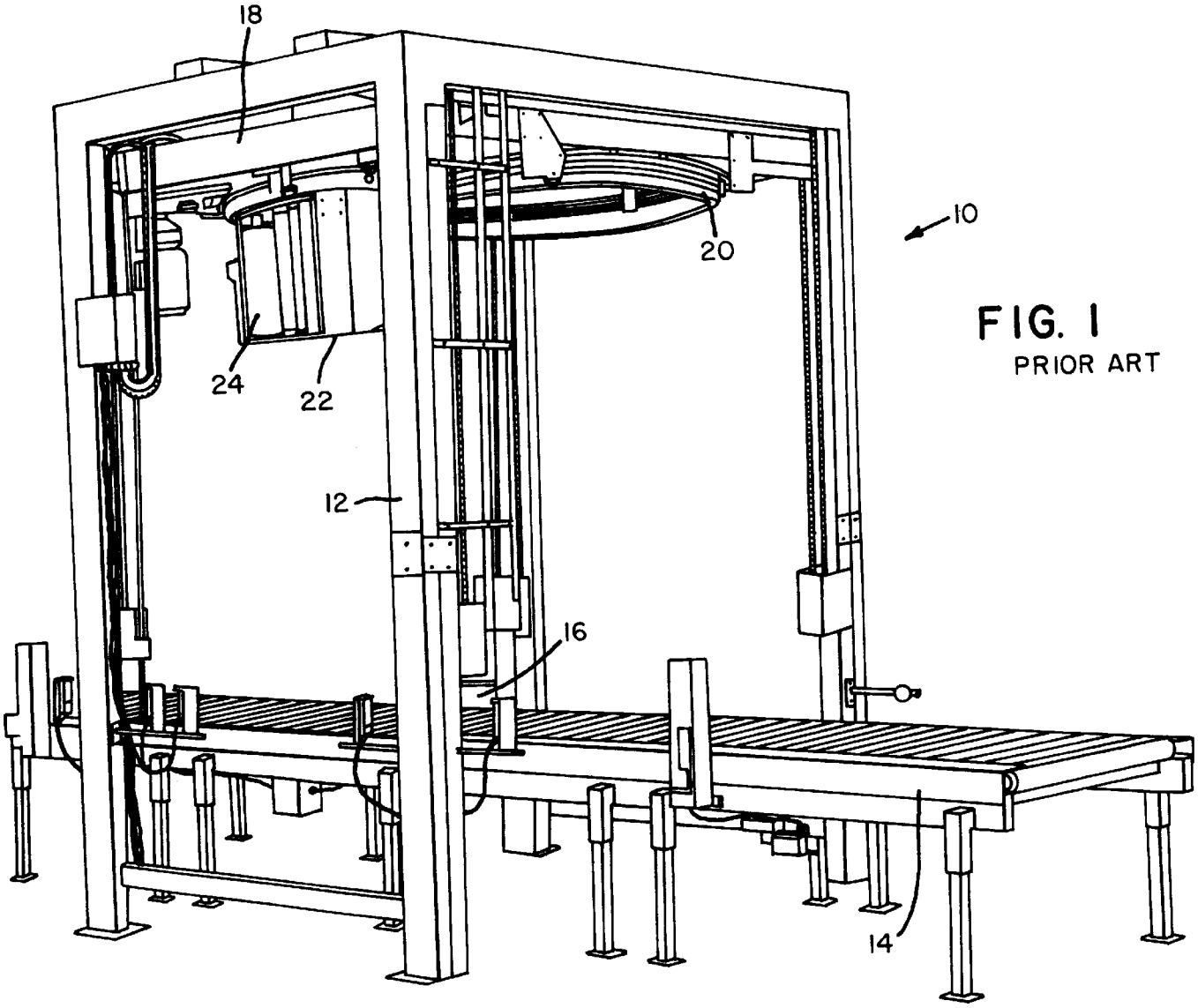
FIG. 1 PRIOR ART
FIG. 1 is a perspective view of a conventional, PRIOR ART film wrapping or packaging machine or apparatus within which a conventional film roll mounting assembly or framework and film roll mounting and dispensing assembly are employed.

Referring again to the drawings, and more particularly to FIG. 5–8 thereof, the new and improved film roll mounting assembly or framework constructed in accordance with the principles and teachings of the present invention is disclosed so as to show the cooperative parts thereof and is generally indicated by the reference character 110. It is to be noted that component parts of the assembly or framework 110 which are similar to the component parts of the PRIOR ART or conventional assemblies or frameworks shown in FIGS. 1–4 are designated by similar reference characters except that the reference characters for the component parts of the present invention as illustrated in FIGS. 5–8 are in the 100 series. The film roll mounting assembly or framework 110 is seen to comprise a first vertically disposed inner frame member 138, which is actually a part of, or fixedly secured to, the film roll mounting and dispensing assembly 122, and a second oppositely disposed, laterally spaced, vertically extending outer frame member 140. As can best be seen from FIG. 6, the film roll mounting framework 110 further comprises an upper transversely disposed frame member 142 which serves to rigidly interconnect the upper end portions of the inner and outer vertically disposed frame members 138 and 140, and a lower transversely disposed frame member 144, which is illustrated within all of the FIGS. 5–8, and which similarly serves to rigidly interconnect the lower end portions of the inner and outer vertically disposed frame members 138 and 140. It can thus be appreciated that the inner and outer frame members 138 and 140, along with the upper and lower frame members 142 and 144, together define a rigid, four-sided external framework 146.

Figure 8:
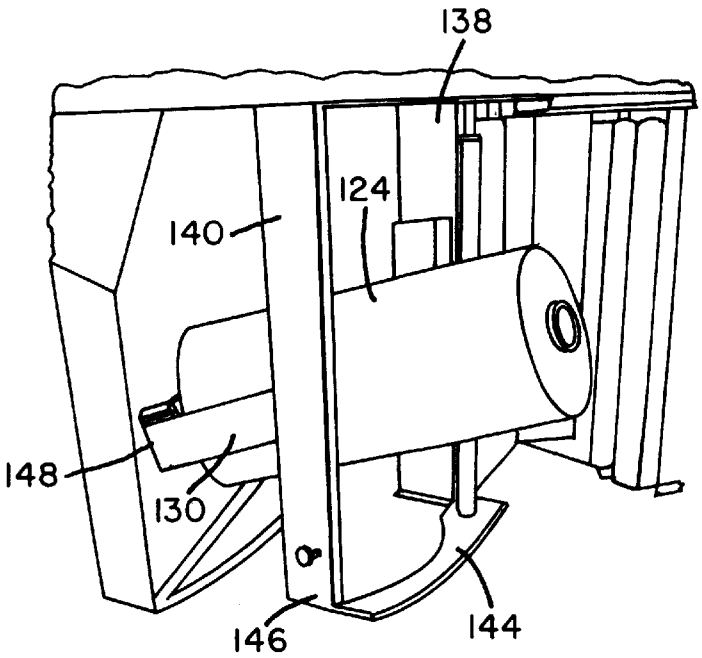
FIG. 8 is a front perspective view substantially corresponding to that of FIG. 7 showing, however, a roll of plastic wrapping film material mounted upon the spindle of the film roll mounting assembly or framework of FIG. 7.

Referring again to FIGS. 5–8, and as best seen in FIGS. 5 and 6, the film roll mounting assembly or framework 110 further comprises a three-sided internal framework 148 which actually serves to pivotally mount a roll 124 of plastic film wrapping material with respect to the external framework 146 and the film roll mounting and dispensing assembly 122. In particular, the three-sided internal framework 148 comprises a first vertically disposed inner frame member 128 and a second oppositely disposed, laterally spaced, vertically extending outer frame member 130. A base member 132 completes the three-sided internal framework 148 and serves to rigidly interconnect the lower end portions of the inner and outer frame members 128 and 130 of the framework 148. A film roll mounting spindle or post 134 is fixedly mounted upon a central portion of the base member 132 and extends upwardly therefrom so as to mount a roll 124 of plastic film wrapping material thereon as seen in FIG. 8.

Figure 6:
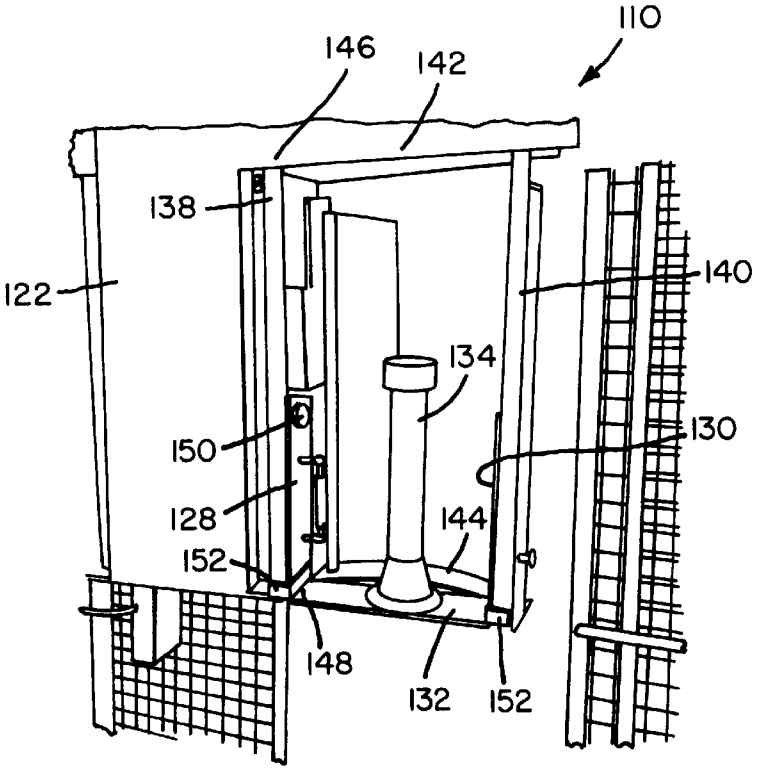
FIG. 6 is a view similar to that of FIG. 5 showing, however, the film roll mounting assembly or framework disposed in its vertically oriented operative mode.
Figure 5:
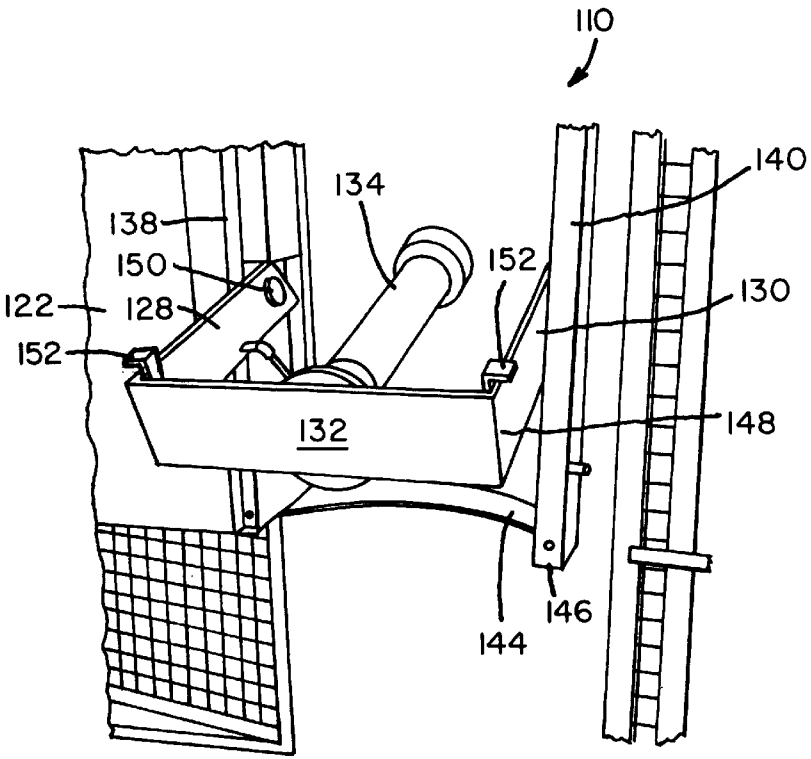
FIG. 5 is a rear perspective view of the new and improved film roll mounting assembly or framework and film roll mounting and dispensing assembly constructed in accordance with the principles and teachings of the present invention and showing the cooperative parts thereof when the film roll mounting assembly or framework is disposed in its tilted or inclined mode so as to facilitate the removal and mounting of rolls of plastic wrapping film from and upon the film roll mounting and dispensing assembly.
Figure 7:
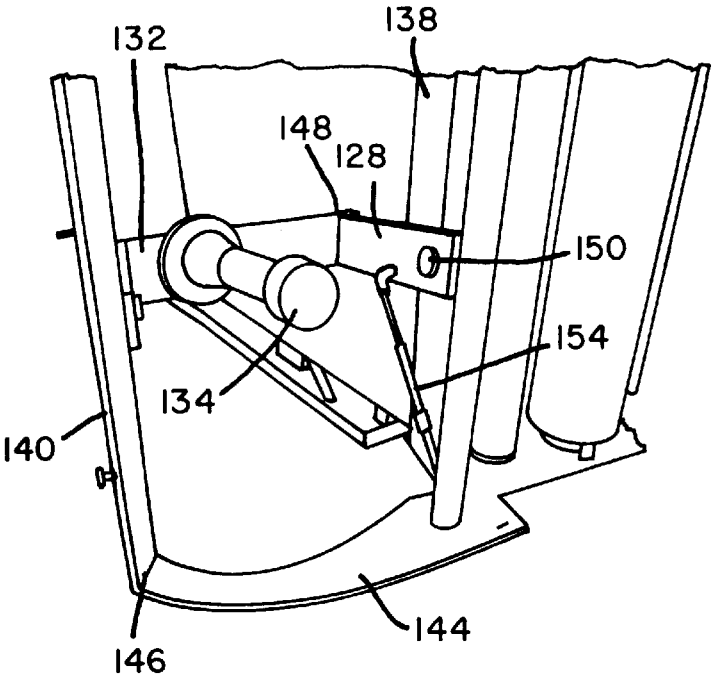
FIG. 7 is a front perspective view corresponding to that of FIG. 5 and additionally showing the use of a hydraulic strut or shock absorber mechanism utilized in conjunction with the film roll mounting assembly or framework wherein the hydraulic strut or shock absorber is used not only to minimize or eliminate any vibrations of the film roll mounting assembly or framework with respect to the surrounding framework formed upon the film roll mounting and dispensing assembly, but in addition, the hydraulic strut or shock absorber mechanism serves to hold or retain the film roll mounting assembly or framework in its opened,tilted or inclined mode so as to facilitate the loading and unloading of rolls of plastic wrapping film material upon the film roll mounting and dispensing assembly.

Each one of the upper end portions of the inner and outer vertically extending frame members 128 and 130 of internal framework 148 is pivotally mounted upon a respective one of the inner and outer vertically extending frame members 138 and 140 of external framework 146 by means of pivot pins or trunnions 150, only one of which is shown in the drawings. It is thus appreciated that the pivot pins or trunnions 150 permit the internal framework 148 to be pivoted with respect to the external framework 146 between its closed position as illustrated in FIG. 6 and its opened position as illustrated in FIGS. 5, 7 and 8. In this manner, the roll 124 of plastic film wrapping material, mounted upon the internal framework 148, can be pivotally moved between a vertically oriented operative position, as illustrated in FIG. 6, whereby plastic film wrapping material can be withdrawn or dispensed therefrom, and a tilted or inclined position, as illustrated in FIGS. 5,7 and 8, whereby the replacement or exchange of the rolls of plastic film wrapping material is facilitated.

It is noted, as best seen in FIGS. 5 and 6, that lower rearward edge portions of the inner and outer frame members 128 and 130 of the internal framework 148 are provided with laterally outwardly extending flanges or ears 152 such that when the internal framework 148 is pivotally moved to its closed position at which the spindle 134 is disposed in its vertical mode, the laterally extending or projecting flange or ear portions 152 of the internal framework 148 will respectively engage lower rearward edge portions of the inner and outer frame members 138 and 140 of the external framework 146 so as to limit or define the extent to which the internal framework 148 can be pivotally moved to its closed position with respect to the external framework 146. In addition, in view of the fact that when the plastic film wrapping material is withdrawn or dispensed from the roll 124 of plastic film wrapping material, the plastic film wrapping material is withdrawn or pulled in a direction which tends to pull the pivotal internal framework 148 in the direction extending from its opened position toward its closed position, and therefore, the projecting flange or ear portions 152, by engaging the rear edge portions of the inner and outer frame members 138 and 140 of the external framework 146, in effect, prevent over-travel of the pivotal internal framework 148 with respect to the external framework 146.

It is further seen from FIG. 7 that a hydraulic strut 154, or similar device containing a similarly acting fluid, has its opposite ends thereof mounted upon and interconnected to the inner frame members 128 and 138 of the internal and external frameworks 148 and 146. In this manner, when the internal framework 148 is moved to its opened position, at which the spindle 134 and the roll 124 of plastic film wrapping material mounted thereon are inclined or tilted with respect to the external framework 146 so as to facilitate the mounting and dismounting of a roll 124 of plastic film wrapping material upon the spindle 134 and the internal framework 148, the strut 154, in an operative manner similar to corresponding strut members employed upon, for example, the trunk lids or front hoods of motor vehicles, assists the opening of the internal framework 148 with respect to the external framework 146 and also serves to hold the internal framework 148 at its opened position so as to facilitate the replacement or exchange of rolls 124 of plastic film wrapping material.

Figure 2:
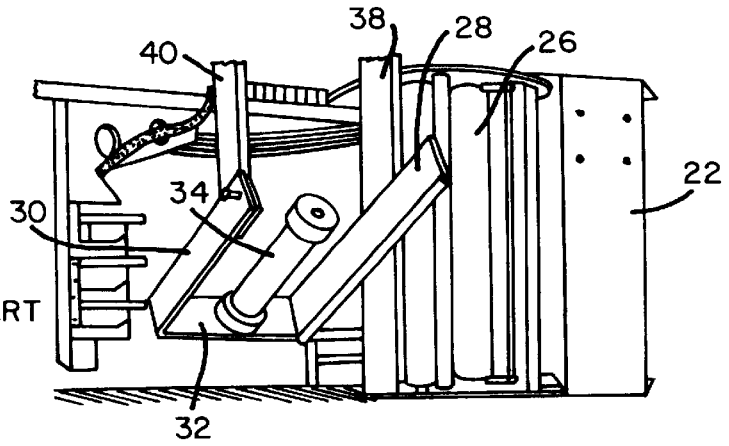
FIG. 2 PRIOR ART
FIG. 2 is a front perspective view of the conventional film roll mounting assembly or framework, as mounted upon the conventional film roll mounting and dispensing assembly shown in FIG. 1, wherein the film roll mounting assembly or framework is disposed in its tilted or inclined mode so as to facilitate the removal and mounting of rolls of plastic wrapping film from and upon the film roll mounting and dispensing assembly.
Figure 3:
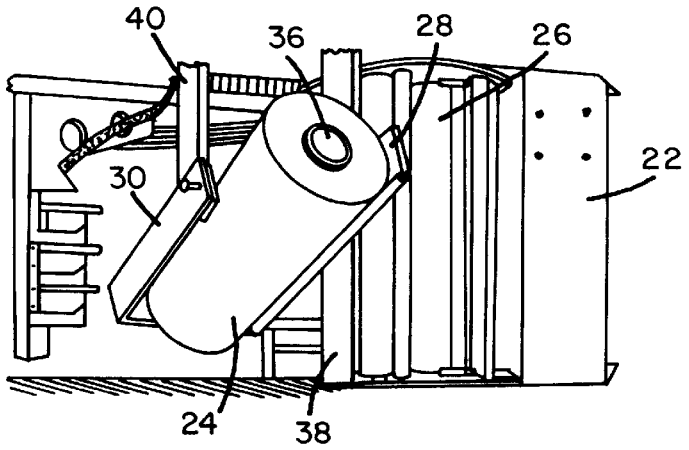
FIG. 3 PRIOR ART
FIG. 3 is a front perspective view similar to that of FIG. 2 showing, however, a roll of plastic wrapping film mounted upon the spindle of the film roll mounting assembly or framework.
Figure 4:
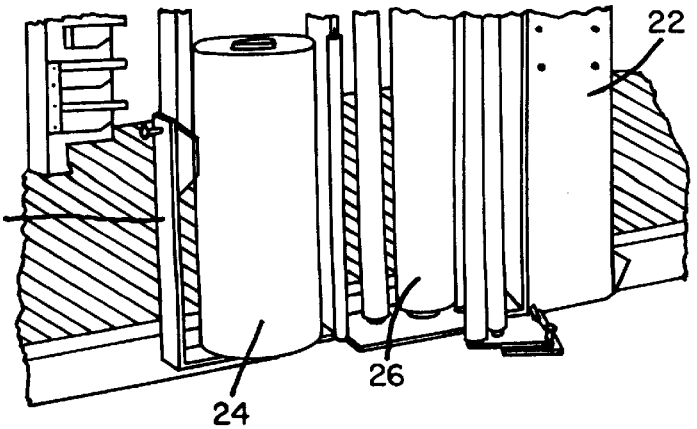
FIG. 4 PRIOR ART
FIG. 4 is a front perspective view of the conventional film roll mounting assembly or framework, as shown in FIG. 3, wherein the film roll mounting assembly or framework is disposed in its vertically oriented operative mode and has a roll of plastic wrapping film mounted thereon and from which the plastic wrapping film may be withdrawn and dispensed for use within a package wrapping operation.

In accordance with the teachings and principles of the present invention, and in view of the detailed description of the invention as set forth hereinbefore, it is most important to appreciate the structural difference of the external framework 146 of the present invention as compared to the external framework of the conventional or PRIOR ART system as illustrated in FIGS. 2–4, as well as the structural and operative interaction between the external framework 146 of the present invention and the internal framework 148 of the present invention, particularly as compared to the structural and operative interaction between the corresponding frame members of the noted PRIOR ART system.

In particular, in view of the fact that the outer frame member 130 of the internal framework 148 is pivotally mounted upon a substantially intermediate portion of the outer frame member 140 of the external framework 146, as opposed to being pivotally mounted upon the lower end portion of the outer frame member as was the case of the outer frame member 30 with respect to the outer frame member 40 in the PRIOR ART conventional system disclosed in FIGS. 2–4, and in view of the additional fact that such structural interrelationship therefore also permits the lower end portion of the outer frame member 140 of the external framework 146 to extend downwardly to a level which is beneath the lower end of the outer frame member 130 as well as beneath base member 132 whereby the lower end portion of the outer frame member 140 of the external framework 146 can be rigidly connected to the lower end portion of the inner frame member 138 by means of the transversely extending frame member 144, the outer framework 146 of the present invention comprises a rigidified four-sided structural framework which surrounds or encloses the three-sided internal framework 148, mounting the roll 124 of plastic film wrapping material, so as to support the same in a substantially vibration-free manner.

Thus, it may be seen that in accordance with the principles and teachings of the present invention, a new and improved mounting assembly or framework, for mounting a roll of plastic film wrapping material upon a wrapping or packaging machine, has been developed wherein the framework is rigidified and stabilized such that the roll of wrapping film material will not undergo or experience any substantial vibration during, for example, film payout or dispensing attendant a film package wrapping operation. In this manner, proper payout or dispensing of the plastic wrapping film material is achieved, as well as proper tensioning thereof, and still further excessive wear upon the apparatus framework components is effectively eliminated or substantially reduced.

Obviously, many modifications and variations of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A framework assembly for pivotally mounting a component with respect to a fixed support of a film wrapping apparatus, comprising:

a substantially non-movable external framework comprising a plurality of structural members which are arranged in a substantially planar perimeter array and which are fixed at predetermined positions with respect to the fixed support of the film wrapping apparatus so as to define a substantially enclosed space within said substantially planar perimeter array;

a component to be movably mounted between first and second positions with respect to said substantially non-movable, fixed external framework and said substantially enclosed space defined therein;

an internal framework, comprising a plurality of structural members arranged in a substantially planar array, upon which said component is fixedly mounted; and means pivotally mounting said internal framework upon two of said structural members of said substantially non-movable, fixed external framework for permitting said internal framework and said component to be pivotally moved between said first and second positions with respect to said substantially non-movable, fixed external framework and said substantially enclosed space such that when said internal framework and said component are disposed at said first position, said substantially planar perimeter array of said internal framework is disposed in a substantially coplanar manner with respect to said substantially planar perimeter array of said substantially non-movable, fixed external framework, whereas when said internal framework and said component are disposed at said second position, said substantially planar perimeter array of said internal framework, upon which said component is fixedly mounted, is no longer disposed in a substantially coplanar manner with respect to said substantially planar perimeter array of said substantially non-movable, fixed external framework.

2. The framework assembly as set forth in claim 1, wherein:

said external framework comprises a four-sided framework surrounding and defining said substantially enclosed space; and said internal framework comprises a three-sided framework pivotally disposed internally of said external framework.

3. The framework assembly as set forth in claim 2, wherein:

said four-sided external framework comprises a pair of substantially vertically extending laterally spaced frame members, and a pair of upper and lower transversely disposed frame members respectively interconnecting upper and lower end portions of said pair of laterally spaced frame members; and said three-sided internal framework comprises a pair of laterally spaced frame members which are respectively pivotally mounted upon said vertically extending laterally spaced frame members of said external framework, and a transversely disposed base member interconnecting said pair of laterally spaced frame members of said internal framework.

4. The framework assembly as set forth in claim 3, wherein:

said component comprises spindle means fixedly mounted upon said base member of said internal framework for mounting a roll of plastic film wrapping material thereon.

5. The framework assembly as set forth in claim 4, wherein:

said internal framework, and said spindle means mounted thereon, are movable between said first position which is an operative position at which said laterally spaced frame members of said internal framework, and said spindle means mounted upon said internal framework, are disposed vertically such that said plastic film wrapping material can be withdrawn and dispensed from the roll of plastic film wrapping material, and said second position at which said internal framework, and said spindle means mounted thereon, is inclined with respect to said vertically extending, laterally spaced frame members of said external framework such that rolls of plastic film wrapping material can be mounted upon and dismounted from said spindle means of said internal framework.

6. The framework assembly as set forth in claim 5, wherein:

said pair of laterally spaced frame members of said internal framework comprise outwardly projecting flange means for engaging said laterally space frame members of said external framework so as to limit the pivotal movement of said internal framework with respect to said external framework and define said first operative position of said internal framework with respect to said external framework when said internal framework is moved from said second inclined position to said first operative position.

7. The framework assembly as set forth in claim 5, further comprising:

strut means interconnecting at least one of said laterally spaced frame members of said internal framework with at least one of said laterally spaced frame members of said external framework for assisting the pivotal movement of said internal framework with respect to said external framework from said first position to said second position and for holding said internal framework at said second position with respect to said external framework.

8. A framework assembly for pivotally mounting a roll of film wrapping material upon a dispensing assembly of a film wrapping packaging machine, comprising:

a film wrapping material dispensing assembly;

an external framework comprising a plurality of structural members arranged in a perimeter array defining a substantially enclosed space within said perimeter array and fixedly mounted upon said film wrapping material dispensing assembly;

an internal framework;

spindle means fixedly mounted upon said internal framework for mounting a roll of film wrapping material thereon; and means pivotally mounting said internal framework upon two of said structural members of said external framework such that said internal framework and said spindle means are pivotally moved between a first position with respect to said external framework and said substantially enclosed space at which said spindle means is disposed at a first operative position from which film wrapping material can be withdrawn and dispensed from the roll of film wrapping material by said film wrapping material dispensing assembly, and a second position with respect to said external framework and said substantially enclosed space at which said spindle means is disposed at a second operative position where rolls of film wrapping material can be mounted upon and dismounted from said spindle means.

9. The framework assembly as set forth in claim 8, wherein:

said external framework comprises a four-sided framework surrounding and defining said substantially enclosed space; and said internal framework comprises a three-sided framework pivotally disposed internally of said external framework.

10. The framework assembly as set forth in claim 9, wherein:

said four-sided external framework comprises a pair of substantially vertically extending laterally spaced frame members, and a pair of upper and lower transversely disposed frame members respectively interconnecting upper and lower end portions of said pair of laterally spaced frame members; and said three-sided internal framework comprises a pair of laterally spaced frame members which are respectively pivotally mounted upon said vertically extending laterally spaced frame members of said external framework, and a transversely disposed base member interconnecting said pair of laterally spaced frame members of said internal framework.

11. The framework assembly as set forth in claim 10, wherein:

said spindle means is fixedly mounted upon said base member of said internal framework for mounting a roll of plastic film wrapping material thereon.

12. The framework assembly as set forth in claim 11, wherein:

said internal framework, and said spindle means mounted thereon, are movable between said first position which is an operative position at which said laterally spaced frame members of said internal framework, and said spindle means mounted upon said internal framework, are disposed vertically such that said plastic film wrapping material can be withdrawn and dispensed from the roll of plastic film wrapping material, and said second position at which said internal framework, and said spindle means mounted thereon, is inclined with respect to said vertically extending, laterally spaced frame members of said external framework such that rolls of plastic film wrapping material can be mounted upon and dismounted from said spindle means of said internal framework.

13. The framework assembly as set forth in claim 12, wherein:

said pair of laterally spaced frame members of said internal framework comprise outwardly projecting flange means for engaging said laterally spaced frame members of said external framework so as to limit the pivotal movement of said internal framework with respect to said external framework and define said first operative position of said internal framework with respect to said external framework when said internal framework is moved from said second inclined position to said first operative position.

14. The framework assembly as set forth in claim 12, further comprising:

strut means interconnecting at least one of said laterally spaced frame members of said internal framework with at least one of said laterally spaced frame members of said external framework for assisting the pivotal movement of said internal framework with respect to said external framework from said first position to said second position and for holding said internal framework at said second position with respect to said external framework.

15. The framework assembly as set forth in claim 10, wherein:

one of said pair of substantially vertically extending laterally spaced frame members is fixedly mounted upon said film wrapping material dispensing assembly.

16. In a film wrapping packaging machine, wherein a framework assembly is provided for pivotally mounting a roll of film wrapping material upon a film dispensing assembly of the film wrapping packaging machine, comprising:

a fixed framework defining a wrapping station at which articles to be packaged are to be disposed;

a vertically reciprocable framework movably mounted upon said fixed framework;

a film wrapping material dispensing assembly movably mounted upon said vertically reciprocable framework;

an external framework comprising a plurality of structural members arranged in a perimeter array defining a substantially enclosed space within said perimeter array and fixedly mounted upon said film wrapping material dispensing assembly;

an internal framework;

spindle means fixedly mounted upon said internal framework for mounting a roll of film wrapping material thereon; and means pivotally mounting said internal framework upon two of said structural members of said external framework such that said internal framework and said spindle means are pivotally moved between a first position with respect to said external framework and said substantially enclosed space at which said spindle means is disposed at a first operative position from which film wrapping material can be withdrawn and dispensed from the roll of film wrapping material by said film wrapping material dispensing assembly, and a second position with respect to said external framework and said substantially enclosed space at which said spindle means is disposed at a second operative position where rolls of film wrapping material can be mounted upon and dismounted from said spindle means.

17. The machine as set forth in claim 16, wherein:

said external framework comprises a four-sided framework surrounding and defining said substantially enclosed space; and said internal framework comprises a three-sided framework pivotally disposed internally of said external framework.

18. The machine as set forth in claim 17, wherein:

said four-sided external framework comprises a pair of substantially vertically extending laterally spaced frame members, and a pair of upper and lower transversely disposed frame members respectively interconnecting upper and lower end portions of said pair of laterally spaced frame members; and said three-sided internal framework comprises a pair of laterally spaced frame members which are respectively pivotally mounted upon said vertically extending laterally spaced frame members of said external framework, and a transversely disposed base member interconnecting said pair of laterally spaced frame members of said internal framework.

19. The machine as set forth in claim 18, wherein:

said spindle means is fixedly mounted upon said base member of said internal framework for mounting a roll of plastic film wrapping material thereon.

20. The machine as set forth in claim 19, wherein:

said internal framework, and said spindle means mounted thereon, are movable between said first position which is an operative position at which said laterally spaced frame members of said internal framework, and said spindle means mounted upon said internal framework, are disposed vertically such that said plastic film wrapping material can be withdrawn and dispensed from the roll of plastic film wrapping material, and said second position at which said internal framework, and said spindle means mounted thereon, is inclined with respect to said vertically extending, laterally spaced frame members of said external framework such that rolls of plastic film wrapping material can be mounted upon and dismounted from said spindle means of said internal framework.

21. The machine as set forth in claim 20, wherein:

said pair of laterally spaced frame members of said internal framework comprise outwardly projecting flange means for engaging said laterally spaced frame members of said external framework so as to limit the pivotal movement of said internal framework with respect to said external framework and define said first operative position of said internal framework with respect to said external framework when said internal framework is moved from said second inclined position to said first operative position.

22. The machine as set forth in claim 20, further comprising:

strut means interconnecting at least one of said laterally spaced frame members of said internal framework with at least one of said laterally spaced frame members of said external framework for assisting the pivotal movement of said internal framework with respect to said external framework from said first position to said second position and for holding said internal framework at said second position with respect to said external framework.

23. The machine as set forth in claim 18, wherein:

one of said pair of substantially vertically extending laterally spaced frame members is fixedly mounted upon said film wrapping material dispensing assembly.

24. A framework assembly for pivotally mounting a component with respect to a fixed support of a film wrapping apparatus, comprising:

a substantially non-movable four-sided external framework comprising a plurality of structural members which are arranged in a perimeter array and which are fixed at predetermined positions with respect to the fixed support of the film wrapping apparatus so as to define a substantially enclosed space within said perimeter array;

a component to be movably mounted between first and second positions with respect to said substantially non-movable, fixed four-sided external framework and said substantially enclosed space defined therein;

a three-sided internal framework comprising a pair of laterally spaced structural side members, and a base member interconnecting lower end portions of said pair of laterally spaced structural side members and upon which said component is fixedly mounted; and means pivotally mounting said pair of laterally spaced structural side members of said internal framework upon two laterally spaced structural members of said substantially non-movable, fixed four-sided external framework for permitting said internal framework and said component to be pivotally moved between said first and second positions with respect to said substantially non-movable, fixed four-sided external framework and said substantially enclosed space.

25. The framework assembly as set forth in claim 24, wherein:

said component comprises spindle means fixedly mounted upon said base member of said internal framework for mounting a roll of plastic film wrapping material thereon.

26. The framework assembly as set forth in claim 25, wherein:

said internal framework, and said spindle means mounted thereon, are movable between said first position which is an operative position at which said laterally spaced frame members of said internal framework, and said spindle means mounted upon said internal framework, are disposed vertically such that said plastic film wrapping material can be withdrawn and dispensed from the roll of plastic film wrapping material, and said second position at which said internal framework, and said spindle means mounted thereon, are inclined with respect to a vertical plane such that rolls of plastic film wrapping material can be mounted upon and removed from said spindle means of said internal framework.

27. The framework assembly as set forth in claim 26, wherein:

said pair of laterally spaced frame members of said internal framework comprise outwardly projecting flange means for engaging said laterally spaced frame members of said four-sided external framework so as to limit the pivotal movement of said internal framework with respect to said external framework and define said first operative position of said internal framework with respect to said external framework when said internal framework is moved from said second inclined position to said first operative position.

28. The framework assembly as set forth in claim 26, further comprising:

strut means interconnecting at least one of said laterally spaced frame members of said internal framework with at least one of said laterally spaced frame members of said external framework for assisting the pivotal movement of said internal framework with respect to said external framework from said first position to said second position and for holding said internal framework at said second position with respect to said external framework.

* * * * *